US011069980B2

(12) United States Patent
Othmezouri et al.

(10) Patent No.: US 11,069,980 B2
(45) Date of Patent: Jul. 20, 2021

(54) LAYERED WAVEGUIDE SYSTEM AND METHOD OF FORMING A WAVEGUIDE

(71) Applicants: TOYOTA MOTOR EUROPE, Brussels (BE); TEADE AB, Lindome (SE)

(72) Inventors: Gabriel Othmezouri, Brussels (BE); Harald Merkel, Lindome (SE)

(73) Assignees: TOYOTA MOTOR EUROPE, Brussels (BE); TEADE AB, Lindome (SE)

( * ) Notice: Subject to any disclaimer, the term of this patent is extended or adjusted under 35 U.S.C. 154(b) by 0 days.

(21) Appl. No.: 16/489,040

(22) PCT Filed: Feb. 28, 2017

(86) PCT No.: PCT/EP2017/054676
§ 371 (c)(1),
(2) Date: Aug. 27, 2019

(87) PCT Pub. No.: WO2018/157922
PCT Pub. Date: Sep. 7, 2018

(65) Prior Publication Data

US 2020/0014114 A1 Jan. 9, 2020

(51) Int. Cl.
*H01Q 13/02* (2006.01)
*H01P 3/12* (2006.01)

(52) U.S. Cl.
CPC ..... *H01Q 13/0208* (2013.01); *H01P 3/121* (2013.01)

(58) Field of Classification Search
CPC ..... H01P 3/123; H01Q 13/0208; H01Q 13/0291; H02J 7/0029; H02J 7/0026; H02J 7/00302; H02J 2007/0067; H02J 7/00; H02J 7/0025; H02J 7/00306; H02J 7/0031; H02J 7/0048; H02J 7/0049; H02J 7/0063; H02J 7/00712; H02J 7/00714; H02J 7/007182; H02J 7/00719; H02J 7/007192; H02J 7/0077; H02J 7/0086; H02J 7/045; H02J 7/14; H02J 7/1461; B23K 15/0026;
(Continued)

(56) References Cited

U.S. PATENT DOCUMENTS 5,126,750 A * 6/1992 Wang ..... H01Q 19/08 343/786
5,689,275 A * 11/1997 Moore ..... H01Q 3/2676 343/772
(Continued)

FOREIGN PATENT DOCUMENTS

EP 1 398 848 A2 3/2004

OTHER PUBLICATIONS

Takuro Tajima et al., "300-GHz Step-Profiled Corrugated Horn Antennas Integrated in LTCC", IEEE Transactions on Antennas and Propagation, Nov. 2014, pp. 5437-5444, vol. 62, No. 11.
International search Report for PCT/EP2017/054676 dated Oct. 23, 2017 (PCT/ISA/210).
Written Opinion of the International Searching Authority for PCT/EP2017/054676 dated Oct. 23, 2017 (PCT/ISA/237).

*Primary Examiner* — Monica C King
(74) *Attorney, Agent, or Firm* — Sughrue Mion, PLLC

(57) ABSTRACT

The disclosure relates to a waveguide system comprising a plurality of stacked layers. The system further comprises a waveguide in a direction across the layers by providing each layer with a predetermined metal pattern. The disclosure further relates to a method for forming a waveguide.

20 Claims, 1 Drawing Sheet

(58) Field of Classification Search
CPC ..... B23K 15/006; B23K 15/0093; B23K 2101/06; B23K 2101/36; B23K 2103/14; B23K 26/032; B23K 26/082; B23K 26/244; B23K 26/282; B23K 26/32; B23K 26/702; B23K 31/125; B23K 37/00; B23K 37/04; B23K 37/0408; B23K 37/0435; B23K 37/047; H01L 21/0237; H01L 21/02521; H01L 21/0256; H01L 21/02568; H01L 21/02601; H01L 21/02628; H01L 31/0324; H01L 31/035218; H01L 31/035227; H01L 31/035236; H01L 31/1836; H01L 31/1868; H01L 51/005; H01L 51/4233; H01L 51/426; H01L 51/4293; H01L 51/502; H01L 51/5056; H01L 51/5072; H01L 51/5203; H01L 51/56
See application file for complete search history.

(56) References Cited

U.S. PATENT DOCUMENTS

| | | | | |
|---|---|---|---|---|
| 6,005,528 | A * | 12/1999 | Preiss | H01Q 13/0208 333/126 |
| 6,094,175 | A * | 7/2000 | Alessi | H01Q 1/405 333/21 A |
| 6,937,203 | B2 * | 8/2005 | Rao | H01Q 3/2658 333/125 |
| 9,716,316 | B2 * | 7/2017 | Park | H01Q 21/08 |
| 2004/0114854 | A1 | 6/2004 | Ouch | |
| 2008/0040885 | A1 | 2/2008 | Daoud et al. | |
| 2010/0188309 | A1 * | 7/2010 | Orime | H01Q 19/106 343/841 |
| 2013/0113668 | A1 | 5/2013 | Kyriazidou | |
| 2015/0070231 | A1 | 3/2015 | Park et al. | |

* cited by examiner

LAYERED WAVEGUIDE SYSTEM AND METHOD OF FORMING A WAVEGUIDE

CROSS REFERENCE TO RELATED APPLICATIONS

This application is a National Stage of International Application No. PCT/EP2017/054676 filed Feb. 28, 2017.

FIELD OF THE DISCLOSURE

The present disclosure is related to a layered waveguide system and a method of forming a waveguide, in particular configured for a THz and/or submillimeterwave signal transmission.

BACKGROUND OF THE DISCLOSURE

Conventional waveguides and horn antennas are machined from metal blocks or metallized plastic material where the space where the electromagnetic field propagates are cut out. Most of these blocks consist of two split parts that can be assembled after additional electronic has been inserted.

However, prior-art block machining and split block technology is slow and expensive. Integration with additional devices must be done individually. Alignment is critical and the assembly of a system requires advanced robotics and is therefore done almost exclusively by hand.

For example, J.-F. Zürcher and F. E. Gardiol: "Broadband patch antennas", Artech House, Norwood, Mass., 1995 discloses radiation coupled patch antennas providing extended bandwidth.

US 20040114854 A1 discloses an optical waveguide device, layered substrate and electronics using the same.

US 20080040885 A1 refers to a compact functionally layered electronics system.

SUMMARY OF THE DISCLOSURE

Currently, it remains desirable to provide a technology suitable for the mass production of waveguides which in particular also allow forms of waveguides which are not possible with the conventional technology.

Therefore, according to embodiments of the present disclosure, a waveguide system is provided comprising a plurality of stacked layers. The system further comprises a waveguide in a direction across the layers by providing each layer with a predetermined metal pattern. In other words, each layer may comprise a predetermined metal pattern configured such that the metal patterns of the stacked layers form the waveguide.

Accordingly, the present disclosure provides a technology to mass-produce horns and waveguide structures such as filters, couplers, tees, directional elements for microwave, millimeterwave and THz circuits by layered printed circuit board stacks. The method allows for devices that are not possible with Prior Art technology such as inverted horn antenna.

The disclosure creates a structure that yields the same radiation behavior as a horn and the same wave guide behavior than a waveguide.

Generally, a microwave circuit (e.g. based on waveguide technology) represents a three dimensional metallic structure. At certain points, additional devices (amplifiers, transistors, diodes) are required and a set of bias lines must be put to the devices. Instead of integrating the circuit in a MMIC (monolithic microwave integrated circuit) what is not possible when the circuit is large or instead of machining the circuit out of a metal block, the circuit is desirably dissected in a stack of layers. Each layer requires a certain metallization pattern to re-create the original microwave design circuit. Each layer may be treated such that its metallization matches the initial circuit design. Stacking the layers desirably creates the initial microwave circuit.

The circuit may be made self-aligned by positioning marks and holes. Complete microwave circuits can be made very cheaply and are suited for mass production.

The layers may be electronic circuit boards, in particular printed circuit boards and/or flexible circuit boards.

The waveguide may form a corrugated waveguide and/or an antenna, e.g. a horn antenna.

The waveguide may form an inverted horn antenna, e.g. based on the Babinet's principle.

The metallic patterns of the layers may correspond to the design of the waveguide at its respective sections.

The layers may comprise cutouts inside the metallic patterns.

The metal patterns may be electrically connected by a wire.

At least two layers may comprise electronic circuits coupled by electric coupling elements for forming a three-dimensional electronic circuit.

The layers may be separated from each other, e.g. by spacers and/or by dielectric or isolating separation layers.

The disclosure further relates to an antenna comprising a waveguide system as described above.

The disclosure further relates to a radar antenna comprising the antenna as described above.

The disclosure further relates to a radar antenna comprising an array of a plurality of antennas as described above.

The disclosure further relates to a method for forming a waveguide across a plurality of stacked layers by providing the layers with respective metal patterns, the method comprising the steps of: specifying for each layer a boundary condition where metallic surfaces are needed to achieve the waveguide, providing each layer with the metallic surfaces, stacking the layers so that the waveguide is formed.

The method may further comprise the steps of: before the step of stacking the layers, providing at least two layers with an electronic circuit and electric coupling elements, stacking the layers so that the electronic circuits are coupled by the electric coupling elements, in order to form a three-dimensional electronic circuit.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Figure 1:
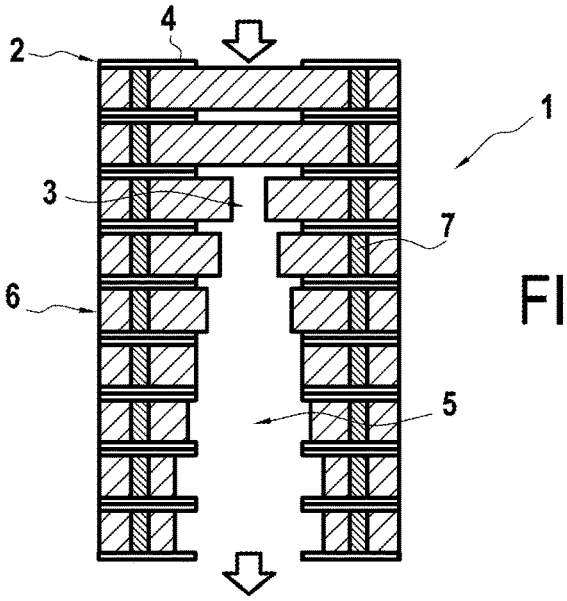
FIG. 1 shows a schematic representation of a wave guide system with a Waveguide transition from dielectric WG to corrugated WG according to an embodiment of the present disclosure.

FIG. 1 shows a schematic representation of a wave guide system with a Waveguide transition from dielectric WG to corrugated WG according to an embodiment of the present disclosure. The shown waveguide system 1 comprises a plurality of stacked layers 2, 6. The layers may be arranged in parallel to each other. The system further comprises a waveguide 3 in a direction across the layers by providing each layer with a predetermined metal pattern 4. The waveguide may extend in a direction perpendicular to the layers 2. The layers 2, 6 may be circuit boards 2, 6, e.g. PCBs. The metal pattern 2 may be printed on the board 6 or provided on its surface in other way. The layers 2, 6 may be separated from each other, in particular by spacers and/or by dielectric or isolating separation layers (not shown).

The metal patterns 4 are desirably electrically connected by wires 7. In other words, two adjacent metal patterns 4 may be electrically connected by one or more wires 7. Desirably there are at least so many wires between two adjacent metal patterns that the distance between to wires is less than the wavelength of the waves, for which the waveguide may be configured (e.g. for 100 GHz or more). The wires may be arranged in a e.g. square form (e.g. 5*4 wires between two adjacent metal patterns) corresponding to the form of the metal patterns. The wires may be arranged in via holes inside the layers.

Typical PCBs may comprise a dielectric coating on their surface (e.g. to protect the PCB against corrosion). This coating may be used in the system to have the effect of a small capacitor.

The metal patterns may have the form of a frame and/or a border with an opening inside. The may have a square and/or rectangular form (e.g. corresponding to the form of the layer (being e.g. a PCB)) or a round form. The resulting waveguide may have a corresponding square and/or rectangular or round form.

As shown in FIG. 1, the layers may comprise cutouts 5 along the waveguide, desirably inside the metal patterns 4. These cutouts may form an opening of the waveguide system. The cutouts are configured such that transmission loss in the waveguide is reduced, what is in particular advantageous at frequencies of transmitted waves of more than 100 GHz.

Said opening may desirably have a conus form (i.e. the waveguide system may form an inverted conus form). In other words the cutouts in the layers may be increasingly large along the waveguide.

However, in a first section of the waveguide comprising a predetermined number of layers (in FIG. 1 e.g. the first two layers) no cutout may be present. At least in this section the waveguide is configured as dielectric waveguide.

The cutouts may become larger than the metal patterns in at least a last section of the waveguide comprising a predetermined number of layers (in FIG. 1 e.g. the last three layers). Accordingly the metal patterns may protrude from the layers in a direction parallel to the layers. Accordingly, the waveguide may form a corrugated waveguide in this last section. Such a corrugated waveguide may be configured for to provide a minimum of reflexion of the transmitted waves.

A waveguide system may comprise e.g. 25 to 30 layers, e.g. PCBs

There may be arranged spacers in between the layers (not shown in the figures).

The layers may be aligned and/or mechanically connected by predefined boreholes in the layers.

Furthermore, also a system of an array of waveguide systems may be provided. In this case at least one of the used layers (e.g. PCBs) may be shared by the plurality of waveguides, desirably at least the first and/or last layer along the waveguides. In other words the shared layers may have a plurality of metal patterns and eventually cutouts, in order to form the array of waveguide systems.

Figure 2:
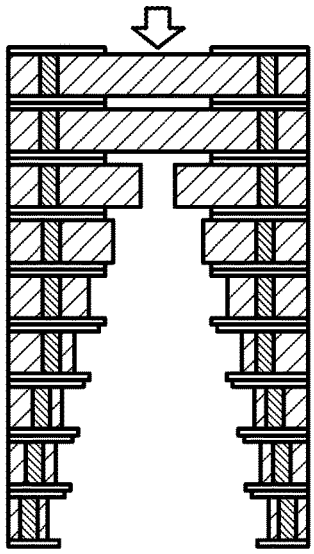
FIG. 2 shows a schematic representation of a wave guide system with a Waveguide transition to a horn antenna according to an embodiment of the present disclosure.

FIG. 2 shows a schematic representation of a wave guide system with a Waveguide transition to a horn antenna according to an embodiment of the present disclosure. The embodiment of FIG. 2 generally corresponds to that one of FIG. 1. However in at least a last section of the waveguide comprising a predetermined number of layers (in FIG. 1 e.g. the last 5 layers) the metal layers may form an increasingly large border along the waveguide, in order to form a horn antenna.

Figure 3:
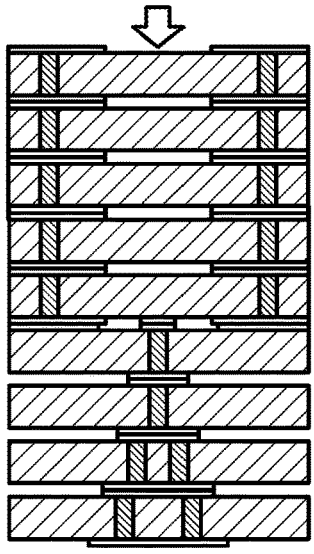
FIG. 3 shows a schematic representation of a wave guide system with a Waveguide transition to an inverted horn antenna according to an embodiment of the present disclosure.

FIG. 3 shows a schematic representation of a wave guide system with a Waveguide transition to an inverted horn antenna according to an embodiment of the present disclosure. In at least a last section of the waveguide comprising a predetermined number of layers (in FIG. 1 e.g. the last 5 layers) the metal layers may form an inverted horn antenna. This may be obtained by the Babinet's principle of a horn antenna. Such an inverted horn antenna has the advantage that effectively larger horns may be created with the same size of used layers.

In the following a method of forming a waveguide (system) according to the disclosure is described.

In a first step, the boundary conditions are specified where metallic surfaces are needed to achieve a certain horn, guide or other function (such as filters and couplers).

In a second step, a direction is specified that will be normal to the layers that are to be created. This direction may be parallel to the direction of propagation of the field but is not limited to.

In a third step, the boundary condition from the first step is sliced in a set of layers, each layer being orthogonal to the direction chosen in the second step. The layer thickness should correspond to the thickness of the printed circuit substrate (i.e. the layer) used below.

In a fourth step, the boundary in each layer is converted into a metallic structure that is printed on the printed circuit board. Eventually via holes are used to connect front and back side of the printed circuit board. Eventually the circuit board substrate may be cut out to form air spaces.

In a fifth step the layers of the printed circuit board are stacked so that the boundary condition from the first step is recreated as a stack of circuit boards.

In creating the boundary condition, it is possible (contrary to conventional waveguide productions) to create boundary conditions that cannot be manufactured using a machining process in a metal block (c.f. inverted horn antenna in FIG. 3, obtained by Babinet's principle of a horn antenna).

The designer may choose freely if the printed circuit board stack will be contacted through or not adding another degree of freedom.

The designer may also choose where to connect the stacks electrically. Additional circuitry (e.g. bias lines) and components (mixers, amplifiers, MMICs) may be mounted on the circuit boards prior to stacking. With the waveguide system of the present disclosure, efficient three dimensional circuits can be created.

Throughout the disclosure, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Furthermore the terms like "upper", "upmost", "lower" or "lowest" and suchlike are to be understood as functional terms which define the relation of the single elements to each other but not their absolute position.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A waveguide system comprising a plurality of stacked layers, the system further comprising a waveguide extending from a first section to a second section in a direction across the layers by providing each layer with a predetermined metal pattern, wherein at least one of the predetermined metal patterns is configured to form a corrugation in the waveguide.

2. The waveguide system according to claim 1, wherein the layers are electronic circuit boards comprised of at least one of: printed circuit boards flexible circuit boards.

3. The waveguide system according to claim 1, wherein the waveguide forms a horn antenna.

4. The waveguide system according to claim 1, wherein the waveguide forms an inverted horn antenna.

5. The system according to claim 1, wherein the metal patterns of the layers correspond to the design of the waveguide at its respective sections.

6. The waveguide system according to claim 1, wherein the layers comprise cutouts inside the metal patterns.

7. The waveguide system according to claim 1, further comprising a wire and wherein the metal patterns are electrically connected by the wire.

8. The waveguide system according to claim 1, wherein at least two layers comprise electronic circuits coupled by electric coupling elements for forming a three-dimensional electronic circuit.

9. The waveguide system according to claim 1, wherein the layers are separated from each other by at least one of: spacers, dielectric, and isolating separation layers.

10. A method for forming a waveguide across a plurality of stacked layers by providing the layers with respective metal patterns, the method comprising the steps of:

specifying for each layer a boundary condition where metallic surfaces are needed to achieve the waveguide, providing each layer with the metallic surfaces, stacking the layers so that the waveguide is formed, and forming a corrugation in the waveguide.

11. The method of the preceding claim 10, further comprising the steps of:

before the step of stacking the layers, providing at least two layers with an electronic circuit and electric coupling elements, and stacking the layers so that the electronic circuits are coupled by the electric coupling elements, in order to form a three-dimensional electronic circuit.

12. The waveguide system according to claim 1, wherein a corrugation is formed at each layer in the second section of the waveguide.

13. The waveguide system according to claim 12, wherein the second section of the waveguide is comprised of at least the last three layers of the waveguide.

14. The waveguide system according to claim 12, wherein the first section of the waveguide contains no corrugation.

15. A waveguide system comprising a plurality of stacked layers, the system further comprising a waveguide extending from a first section to a second section in a direction across the layers by providing each layer with a predetermined metal pattern, and at least one of the layers including a cutout inside a corresponding predetermined metal pattern, wherein at least one of the cutouts is larger than the corresponding predetermined metal pattern.

16. The waveguide system according to claim 15, wherein each layer in the second section of the waveguide includes a cutout that is larger than the corresponding predetermined metal pattern.

17. The waveguide system according to claim 16, wherein the second section of the waveguide is comprised of at least the last three layers of the waveguide.

18. The waveguide system according to claim 16, wherein the first section of the waveguide contains no cutouts.

19. The waveguide system according to claim 18, wherein the first section of the waveguide is comprised of at least the first two layers of the waveguide.

20. The waveguide system according to claim 16, wherein the predetermined metal patterns in the second section of the waveguide protrude from the corresponding layer in a direction parallel to the layer.

* * * * *